US008499461B1

(12) United States Patent
Mollick et al.

(10) Patent No.: US 8,499,461 B1
(45) Date of Patent: Aug. 6, 2013

(54) FOLDING KNIFE BLADE WITH DUAL LOCKING MECHANISM

(76) Inventors: Mark Mollick, Phoenix, AZ (US); Paul Mollick, Phoenix, AZ (US)

( * ) Notice: Subject to any disclaimer, the term of this patent is extended or adjusted under 35 U.S.C. 154(b) by 458 days.

(21) Appl. No.: 12/925,689

(22) Filed: Oct. 26, 2010

(51) Int. Cl.
*B26B 1/04* (2006.01)

(52) U.S. Cl.
USPC ..... 30/160; 30/161

(58) Field of Classification Search
USPC ..... 30/160, 161, 151, 153, 155, 157, 30/159, 158
See application file for complete search history.

(56) References Cited

U.S. PATENT DOCUMENTS

| | | | | | |
|---|---|---|---|---|---|
| 3,942,249 | A | * | 3/1976 | Poehlmann | 30/160 |
| 4,170,061 | A | * | 10/1979 | Henry | 30/160 |
| 4,233,737 | A | * | 11/1980 | Poehlmann | 30/335 |
| 4,541,175 | A | * | 9/1985 | Boyd et al. | 30/161 |
| 4,670,984 | A | | 6/1987 | Rickard | |
| 4,750,267 | A | * | 6/1988 | Boyd | 30/161 |
| 4,901,439 | A | * | 2/1990 | Boyd, Jr. | 30/161 |
| 5,093,995 | A | | 3/1992 | Jan | |
| 5,442,855 | A | | 8/1995 | Jobin | |
| 5,755,035 | A | | 5/1998 | Weatherly | |
| 5,822,866 | A | * | 10/1998 | Pardue | 30/161 |
| 5,964,035 | A | * | 10/1999 | Poehlmann | 30/161 |
| 5,964,036 | A | | 10/1999 | Centofante | |
| 6,370,778 | B1 | | 4/2002 | Conable | |
| 6,553,671 | B2 | | 4/2003 | Blanchard | |
| 7,051,441 | B2 | * | 5/2006 | Carter, III | 30/161 |
| 7,231,718 | B2 | | 6/2007 | Outen | |
| 7,302,760 | B2 | * | 12/2007 | Lake | 30/161 |
| 7,340,837 | B1 | | 3/2008 | Busse | |
| 7,647,701 | B1 | | 1/2010 | Mollick et al. | |
| 2004/0158991 | A1 | * | 8/2004 | Freeman | 30/161 |
| 2005/0223562 | A1 | * | 10/2005 | Pardue et al. | 30/161 |
| 2007/0295293 | A1 | * | 12/2007 | Spath et al. | 123/90.16 |
| 2009/0277015 | A1 | * | 11/2009 | Duey | 30/160 |

* cited by examiner

*Primary Examiner* — Kenneth E. Peterson
*Assistant Examiner* — Jennifer Swinney
(74) *Attorney, Agent, or Firm* — Thomas W. Galvani, P.C.; Thomas W. Galvani

(57) ABSTRACT

A locking mechanism for a folding knife. The locking mechanism has a locking sleeve and an opposed locking bolt which are coaxial and biased to a locking position by a spring. In the locked position, either with the blade extended or folded, both a lug on the bolt and a surface on the sleeve engage a locking surface on the blade tang area. Simultaneous manual force must be applied by the user to oppositely release buttons on the opposite handles to move both the locking bolt and locking sleeve to positions to disengage them from the locking surface to allow the blade to be folded or unfolded.

12 Claims, 5 Drawing Sheets

FOLDING KNIFE BLADE WITH DUAL LOCKING MECHANISM

FIELD OF THE INVENTION

The present invention relates to knives and more particularly to folding blade knives having a locking mechanism for locking the blade in either the retracted or extended position.

BACKGROUND OF THE INVENTION

Folding knives are well known and generally are constructed having a handle which may incorporate liners. A blade is pivotally secured to the forward end of the handle generally by a pivot extending through the tang area of the blade. In the retracted position the blade is positioned within the handle between the liners with the sharpened edge in a protected or sheathed position. In the retracted position, the knife may be more safely carried or handled.

When it is desired to use the knife, the blade is pivoted to a position extending forwardly from the handle. The blade is manually pivoted by the user to the open position sometimes with the assistance of a finger notch near the spine of the blade.

In order to enhance the safety of folding knives, various locking arrangements have been proposed in the prior art. Many of these arrangements utilize a single button or slide which is actuated or depressed to displace a locking pin or element to allow the blade to be folded either to the extending or retracted position. However, many of these locking arrangements are complex, not lending themselves to incorporation in current folding knives designs and are subject to accidental release. Further, many prior art folding knife locking mechanisms are aesthetically objectionable particularly with many specialty and expensive custom knives.

BRIEF SUMMARY OF THE INVENTION

The present invention relates to a dual locking mechanism for a folding knife. The mechanism has a pair of opposed locking elements or members. One of the locking members has a release button or head extending through a bore in one of the handles. The other locking member has a release button or head which extends through a bore in the opposite handle. The locking members are co-axial. One locking member comprises a locking bolt having a cylindrical body having a pair of spaced-apart lugs defining an intermediate groove between the lugs. The opposite locking member comprises a locking sleeve defining an axial slot along its surface. The axial slot has an enlarged section in an intermediate location. The locking bolt is slidable within the body of the locking sleeve.

A spring intermediate the locking member applies a separating, biasing force to the two locking members. The edge of the tang of the knife blade defines a pair of opposed, arcuate recesses for locking the blade in the folded and unfolded positions. A seat is located within each of the recesses. One of the lugs of the locking bolt engages one of the seats in one of the locked positions. In a locked position, a stop surface on the body of the locking sleeve engages the tang surface adjacent the locking recess. The locking members are normally urged or biased to the locked position by the spring.

To unlock the blade from either the extended, locked position, or the blade retracted, locked position, a user must apply a manual inward force simultaneously to both of the locking members using the release buttons in the opposed knife handles. The applied manual force will overcome the spring bias, moving the locking members toward a central position with the groove of the locking bolt member and the wide slot of the surface of the locking sleeve in alignment with each other and also with the tang area of the blade. In this position, the blade is unlocked and may be folded or unfolded as long as the manual unlocking force is maintained on both members. When the manual force is released, the locking members, due to the spring force, will be urged to their locked positions, engaged in one of the locking recesses and associated seat in the blade tang when the blade is in either the folded or unfolded position.

The safety locking mechanism with opposed locking members is adaptable to a wide range of folding knives and an aesthetically acceptable safety feature.

BRIEF DESCRIPTION OF THE DRAWINGS

The above and other advantages and objects of the present invention will become more apparent when taken in conjunction with the following description, claims and drawings in which:

DETAILED DESCRIPTION OF THE DRAWINGS

Figure 1:
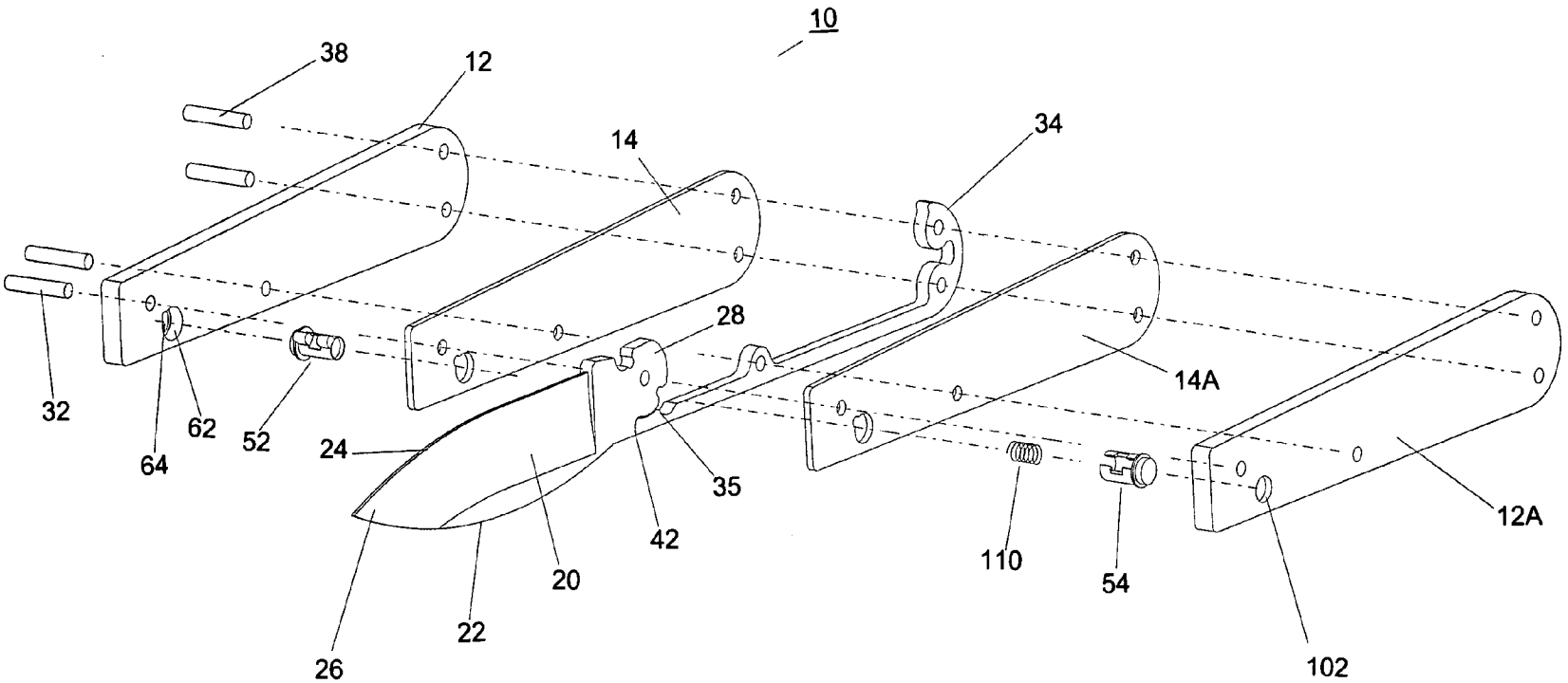
FIG. 1 is an exploded view of a representative folding knife incorporating the dual locking mechanism of the present invention with the blade shown in an open position.

Turning now to the drawings, particularly FIG. 1, which shows a representative folding knife construction of the type to which the dual locking mechanism of the present invention may be applied. As mentioned above, folding knives may have different shapes and dimensions and it will be understood that the following description with reference to FIG. 1 is a general description of a representative folding knife for background and to facilitate an understanding of the present invention.

It will be appreciated that the locking mechanisms of the present may be applied or incorporated into a wide range of folding knife styles, shapes and sizes.

Folding knife 10 has opposite handles 12 and 12A. The handles 12 and 12A may be any suitable material and include suitable decoration. Liners 14, 14A are respectively positioned at the inner sides of the handle. Blade 20 is interposed between the liners. The blade 20 has a back 22, sharpened edge 24, tip 26 and a rear tang area 28. The blade 20 is pivotal between an open and a closed position at pin 32 which extends between the handles. A spacer 34 extends between the liners for the purpose of providing a space for the blade to fall into when the blade is closed. The knife assembly is secured by a plurality of rivets or fasteners 38.

Figure 2:
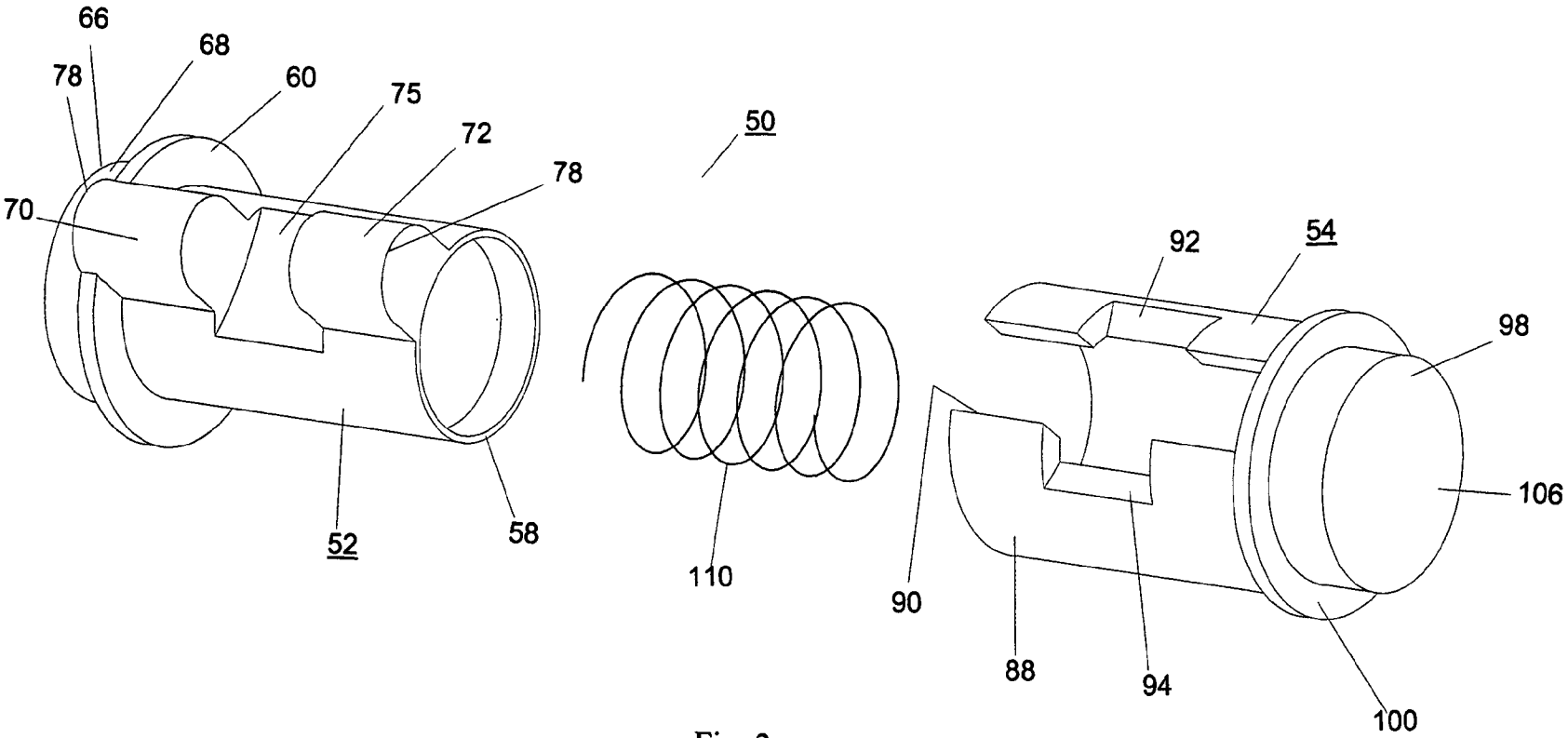
FIG. 2 is an enlarged, exploded view of the dual locking mechanism seen in FIG. 1.

The locking mechanism 50 seen in FIGS. 1 and 2 includes two locking elements 52, 54. Locking element 52 is a bolt having a generally cylindrical body 58 which extends to a location intermediate the liners. The outer end of the body 58 carries a collar 60 which seats in a recess 62 on the inner side of handle 12. A release button 68 extends through bore 64 having a surface 66 which is substantially flush with the outer surface of handle 12. A manual actuating force is applied to the surface of the release button 68 to depress the locking bolt 52 and move it to an unlocked position.

Bolt 52 has a pair of spaced-apart lugs 70, 72 separated by an intermediate groove 75. The lugs each project from the body of the bolt having a curved or arcuate upper surface 78. The width of groove 75 is slightly greater than the width of the tang area of the blade 20.

The opposite locking member 54 has a sleeve-like body 88. The axis of the interior of the body 88 is aligned with the axis of bolt 52 and is sized to allow the locking bolt 52 to reciprocate within the body of the sleeve.

The body 88 of the locking sleeve has an axial slot 90 extending along its surface and aligned with lugs 70, 72. The opposite sides of the slot 90 each have enlarged cut-out sections 92, 94 formed at an intermediate location. The outer end of the body 88 carries an annular collar 100 which seats in a recess 102 on the inner side of the handle 12A. A release button 98 extends through a bore within the recess 102. The release button 98 has a surface 106 which is substantially flush with the outer surface of the handle 12A.

Manual force is applied to the surface 106 to inwardly depress the locking sleeve 54 to move it to an unlocked position. As will be explained, unlocking of the blade can only occur if both the locking bolt and locking sleeve are simultaneously depressed, bringing both to an unlocked position. The locking members are biased outwardly to a normal locked position by spring 110 which is housed in the interior of the sleeve and bolt, applying an outward force to both members.

Figure 3:
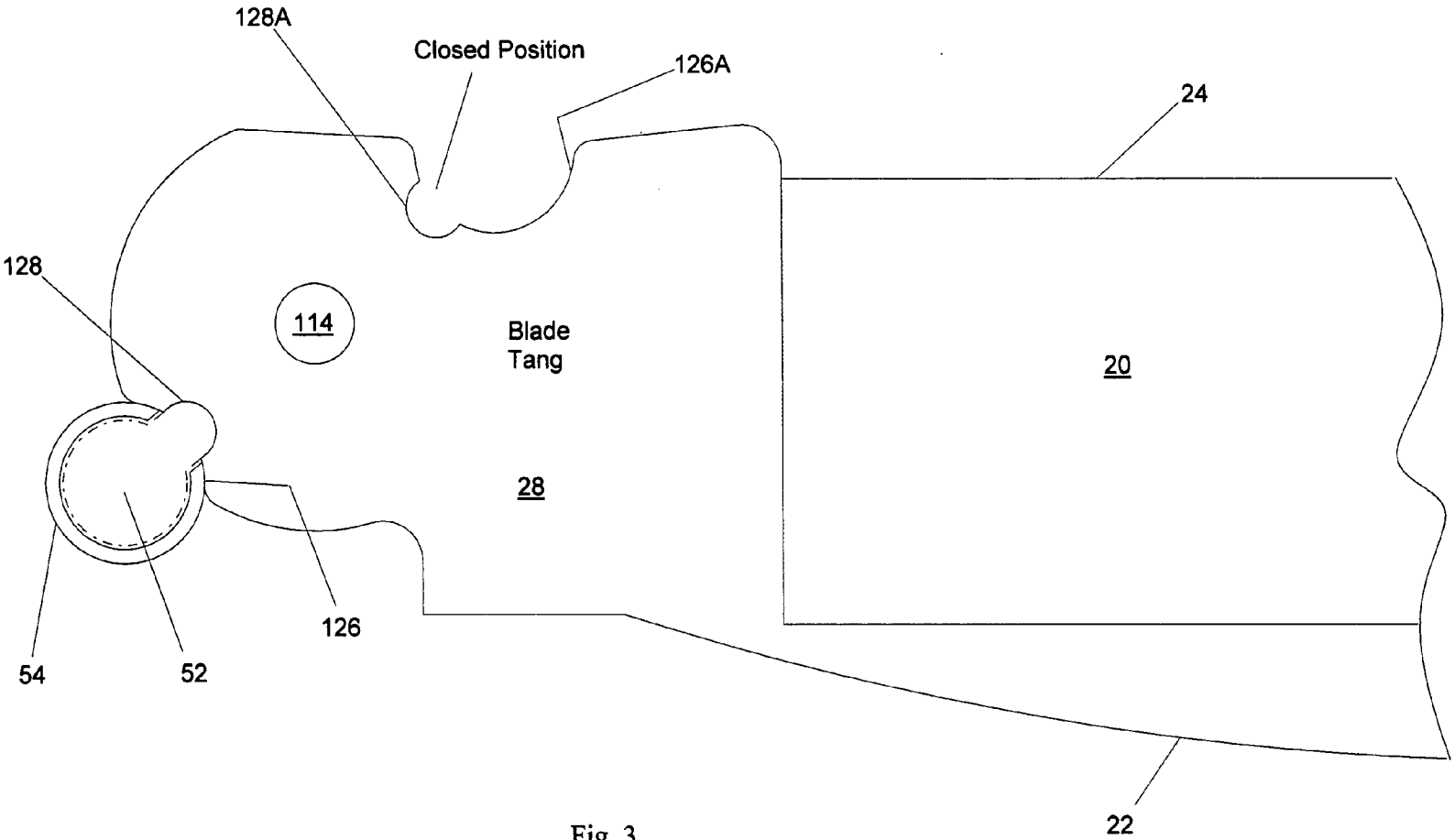
FIG. 3 is a side view of the tang area of the folding knife blade showing the dual locking mechanism engaging the tang to secure the blade in a locked, open position.

Referring to FIG. 3, a portion of the blade 20 and the tang area 28 are shown with the blade locked in an open or unfolded position. The tang area has a bore 114 to receive a pivot pin 32 as described above. The area of the tang 28 on the spine 22 of the blade 20 has an arcuate recess 126 having a curvature conforming to the curvature of the outer surface of the sleeve 54. A seat 128 is defined at a location along the recess and is configured to receive the curved upper end of lug 72 on the locking bolt. The recess 126 and seat 128 engage the locking elements to secure the blade in the open position.

A recess 126A is located generally diagonally opposite recess 126, again having a curvature conforming to the curvature of the outer surface of the locking sleeve. A seat 128A is defined at a location along the recess to receive the curved, upper end of lug 72 in the locked position. The recess 126A and seat 128A in the tang area engage the locking members to maintain the blade in the closed position.

Figure 2B:
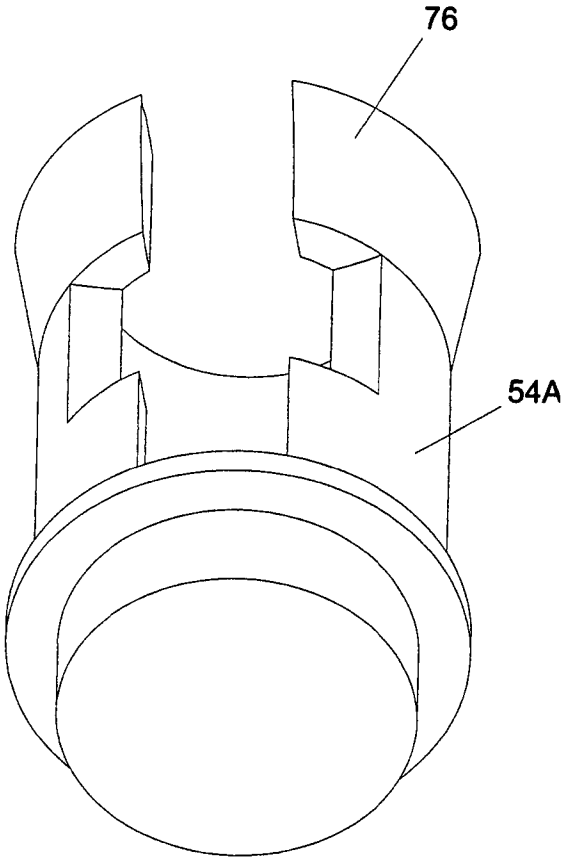
FIGS. 2A and 2B show alternate embodiments of the locking mechanism seen in FIG. 2.
Figure 2A:
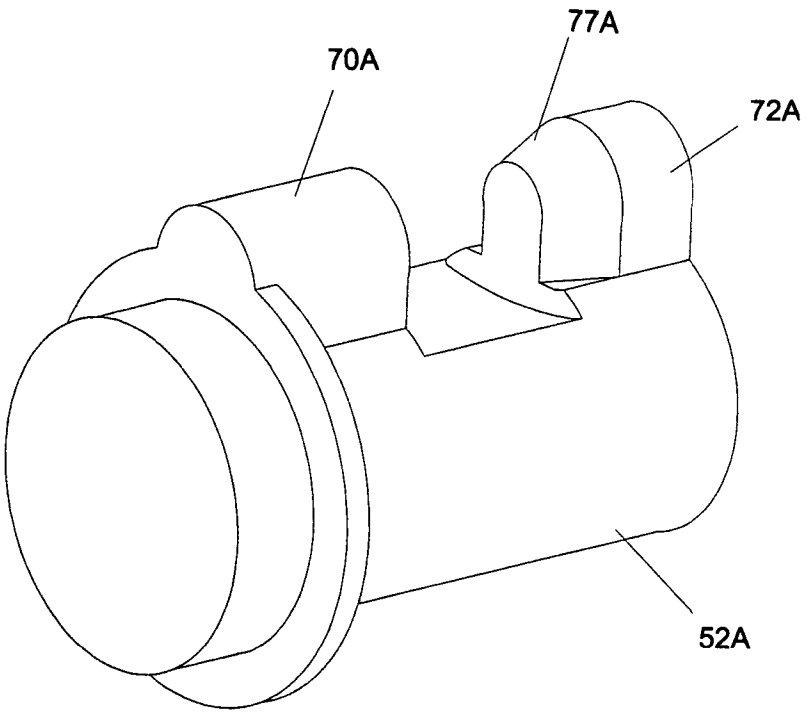

In FIGS. 2A and 2B, alternate embodiments of the locking mechanisms are shown. Locking bolt 52A has been previously described having a body with projecting lugs 70A and 72A. The inner edge of lug 72A is chamfered at 77A to facilitate seating and unseating from the blade tang area.

Similarly, in FIG. 2B the locking sleeve 54A is as described above, but the body has an inner end flared at 76 to facilitate entry and reciprocation of the locking sleeve within the blade.

The present invention will be better understood from the following description of operation:

Operation

When the blade 20 is in the open position with the blade extended and without the user applying a manual force to unlock the blade, the blade is locked by engagement with both the locking bolt 52 and locking sleeve 54. FIG. 3 shows the blade locked in the open position with the curved recess 126 engaged by the sleeve 54 and the seat 128 engaged by lug 72 on the locking bolt 52.

Figure 4:
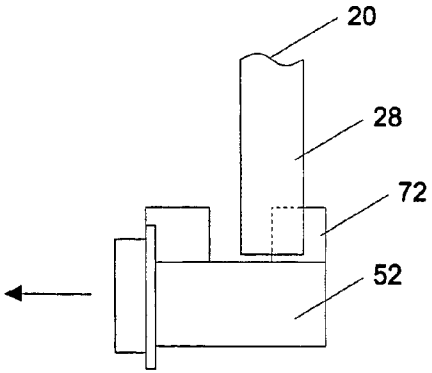
FIG. 4 shows the position of the locking bolt in a normal blade locking position, the second locking sleeve being omitted for purposes of clarity.

FIG. 4 is a simplified view of the locking bolt 52 and the tang area 28 of the blade 20. The arrow indicates the direction of the spring force bias which normally urges the locking bolt to the engaged position shown in FIG. 4. Note the locking sleeve 54 is not shown in the FIG. 4 view. Lug 72 engages one of the seats 128, 128A in the tang area of the blade, as seen in FIG. 3, depending on the position of the blade.

Figure 5:
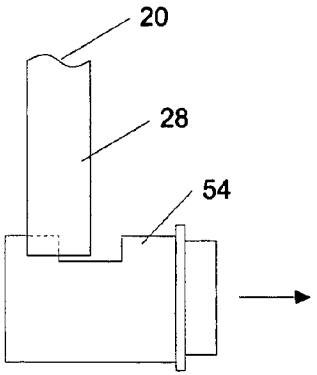
FIG. 5 shows the position of the locking sleeve in a normal blade locking position, the locking bolt being omitted for purposes of clarity.

Referring to FIG. 5, the position of the locking sleeve 54, when engaged to secure the blade in a locked position, is shown. The arrow indicates the direction of the spring force bias. A section of the curved surface of the body of the sleeve adjacent its inner end is in engagement with one of the curved recesses 126, 126A, as also seen in FIG. 3.

Figure 6:
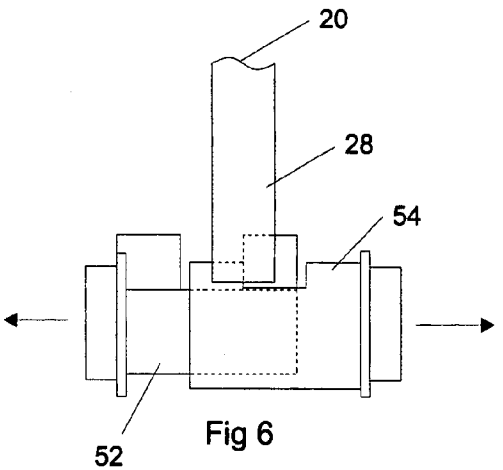
FIG. 6 shows both the locking sleeve and bolt in a normal locking position.

In the normal blade locking position, the biasing spring 110 urges both the locking sleeve and the locking bolt into locking positions engaging the tang area of the blade. FIG. 6 shows the relative position of both the locking bolt 52 and locking sleeve 54 in a locked position. In the blade open position, the locking bolt and locking sleeve are engaged as described above with reference to FIG. 3 and in the opposite seat and recesses 126A, 128A in the closed, locked position.

When the user wishes to unlock the blade to either fold or unfold the blade, the user will simultaneously apply a manual unlocking force to both of the opposed release buttons 68, 98 on the handles 12, 12A.

Figure 7:
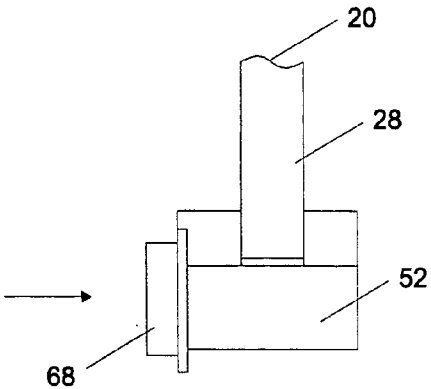
FIG. 7 shows the locking bolt moved to an unlocked position, the opposite locking sleeve being omitted for purposes of clarity.

In FIG. 7, the arrow indicates the direction of the unlocking force applied to the release buttons which force opposes the bias of spring 110, moving the locking bolt 52 to a position in which the groove 75 is aligned with the blade. The unlocking force applied to the locking sleeve 54 moves the sleeve to a position in which the enlarged slot areas 92, 94 are aligned with the blade and the groove 75 in the bolt.

Figure 9:
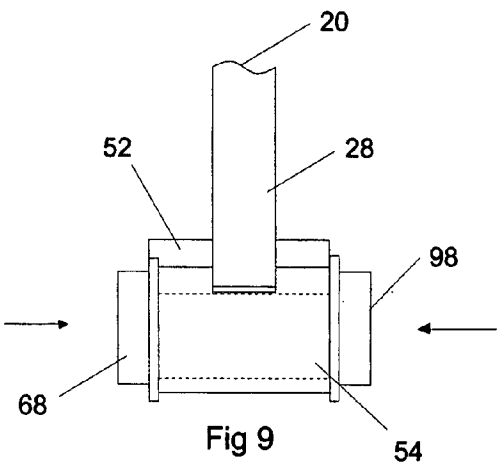
FIG. 9 shows the cooperating dual locking sleeve and bolt both being moved to an unlocked position relative to the knife blade.
Figure 8:
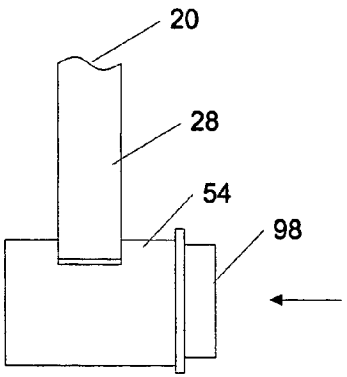
FIG. 8 shows the locking sleeve moved to an unlocked position, the opposite locking bolt not being shown for purposes of clarity.

FIG. 8 shows the sleeve 54 in the unlocked position and FIG. 9 shows both the locking sleeve and bolt in their unlocked positions, out of engagement with the recess and seat in the blade tang area. The blade can now be pivoted to an extended or folded position. Once the blade is moved to either of these positions, the locking members will return to their locked positions engaging one of the recesses and seats in the tang area. The reciprocal engagement of the locking bolt within the locking sleeve also prevents the members from rotating.

The opposed, dual locking members are both safe and convenient. There is a significantly lessened chance of the user unlocking the blade as both locking elements must be simultaneously actuated. Incidental force applied to only one of the locking elements will not unlock the blade. Further, the members are versatile as they lend themselves to use by both right- and left-handed individuals.

It will be obvious to those skilled in the art to make various changes, alterations and modifications to the invention described herein. To the extent such changes, alterations and modifications do not depart from the spirit and scope of the appended claims, they are intended to be encompassed therein.

We claim:

1. A folding knife having a blade pivotally mounted between two handles at a pivot axis extending through the tang area of the blade, said blade having a closed position sheathed between the handles and an open position extending from the handle, said folding knife comprising:

a locking bolt having a body with at least one projecting lug, said body being axially aligned with an axis extending through the tang area of the blade and parallel to the blade pivot axis;

a locking sleeve having a body defining a slot, said sleeve body axially and oppositely aligned with the axis of the locking bolt;

said blade in the tang area defining spaced-apart locking surfaces establishing a closed locked position and an open locked position;

biasing means applying opposite biasing forces to the locking bolt and locking sleeve to normally urge the locking sleeve and locking bolt into engagement with one of said locking surfaces when the blade is either in an open or closed position; and release means associated with each of said locking sleeve and locking bolt and actuable at said handles, said locking sleeve and locking bolt move simultaneously to an unlocked position out of engagement with the locking surfaces on the blade in response to simultaneous depression of both the sleeve and the bolt with respect to the handles.

2. The folding knife of claim 1 wherein the locking bolt has a pair of spaced-apart lugs defining a space therebetween corresponding to the width of the blade tang.

3. The folding knife of claim 1 wherein the locking bolt is reciprocal within the locking sleeve and the biasing means comprises a spring interposed between the locking sleeve and the locking bolt.

4. The folding knife of claim 1 wherein the handles each define a blind bore on their inner sides, said locking sleeve and locking bolt each having a collar seated in the blind bore in the associated handle.

5. The folding knife of claim 4 wherein a bore extends from each said blind bore through said handles and the associated locking sleeve and locking bolt each having a release button in said bore.

6. The folding knife of claim 1 wherein the body of said locking sleeve has a flared inner end.

7. The folding knife of claim 1 wherein the body of said locking bolt has a lug with a curved upper end with a chamfered edge.

8. The folding knife of claim 1 wherein liners are provided at the inner surfaces of said handles.

9. A folding knife having a blade pivotally mounted between two handles at a pivot axis extending through the tang area of the blade, said blade having a closed position sheathed between the handles and an open position extending from the handles, said knife comprising:

a first locking member having a body with at least one locking projection, said body being axially aligned with an axis extending through the tang area of the blade and parallel to the blade pivot axis;

a second locking member having a body defining a slot, said second locking member being oppositely aligned with said first locking member and slidably receiving at least a portion of the body of said first locking member;

said blade in the tang area defining spaced-apart locking surfaces establishing a locked, closed position and a locked, open position;

biasing means applying opposite biasing forces to said first and second locking members to normally urge said locking members into engagement with one of said locking surfaces when the blade is in either open or closed position; and manual release means associated with each of said locking members and actuable at said handles, said members move simultaneously to an unlocked position out of engagement with the locking surfaces on the blade in response to the simultaneous depression of each of the locking members with respect to the handles;

wherein the projection on the first locking member moves through the slot in the second locking member between the unlocked position and either of the locked closed or locked open positions of the locking members.

10. The folding knife of claim 9 wherein the first locking member is reciprocal within the second locking member and the biasing means comprises a spring interposed between the first and second locking members.

11. The folding knife of claim 9 wherein the body of the second locking member has a flared inner end.

12. The folding knife of claim 9 wherein the projection of the first locking member has a chamfered edge.

* * * * *